US007178693B1

(12) United States Patent
Cutrone

(10) Patent No.: US 7,178,693 B1
(45) Date of Patent: Feb. 20, 2007

(54) PACK AND METHOD FOR DISPENSING TOILETRIES

(76) Inventor: Angelo Cutrone, 9 Freeman Ave., Denville, NJ (US) 07834

( * ) Notice: Subject to any disclaimer, the term of this patent is extended or adjusted under 35 U.S.C. 154(b) by 0 days.

(21) Appl. No.: 11/267,856

(22) Filed: Nov. 7, 2005

(51) Int. Cl.
*B67D 5/52* (2006.01)
*G01F 11/00* (2006.01)

(52) U.S. Cl. ..... 222/135; 222/143; 222/181.2; 222/192; 222/321.9

(58) Field of Classification Search ..... 222/1, 222/129, 135, 143, 181.1, 181.2, 192, 321.9
See application file for complete search history.

(56) References Cited

U.S. PATENT DOCUMENTS 2,718,335 A * 9/1955 Shippen ..... 222/135
3,349,967 A * 10/1967 Schneller ..... 222/130
4,969,580 A * 11/1990 Mikhail Ezzat A. ..... 222/181.3
4,998,647 A * 3/1991 Sharp ..... 222/143
5,044,520 A * 9/1991 Moisan ..... 222/2
5,044,522 A * 9/1991 Roig et al. ..... 222/108
6,530,502 B2 * 3/2003 Neal ..... 222/192
6,672,480 B1 * 1/2004 Miller ..... 222/129

* cited by examiner

*Primary Examiner*—Joseph A. Kaufman
(74) *Attorney, Agent, or Firm*—Thomas L. Adams

(57) ABSTRACT

A pack for carrying and dispensing toiletries includes a container having (a) a floor with at least one lower opening, and (b) at least one wall with a front, a back, a right and a left portion. A plurality of bottles with pumping heads that will fit in the container with the pumping heads projecting through the lower opening of the container. Each of the pumping heads when inverted can be operated to dispense fluid from the bottle. The pack also has a cover for locking the bottles in the container and providing a backstop for the bottles during operation of the pumping heads.

17 Claims, 2 Drawing Sheets

PACK AND METHOD FOR DISPENSING TOILETRIES

BACKGROUND OF THE INVENTION

1. Field of the Invention

The present invention relates to containers for holding a number of bottles, and in particular to bottles containing fluids such as toiletries.

2. Description of Related Art

Travelers often carry in their luggage a number of toiletries, such as shampoo, conditioner, body wash or gel, shaving cream, toothpaste, hand or facial lotion, after shave, etc. Full-size bottles of such toiletries are ordinarily too bulky to be carried on most trips. Carrying several miniature bottles may be feasible but finding them all at shower or bath time can be a problem.

Some travelers use a toiletries kit, which is a small zippered pouch holding a variety of toiletries. While such a kit will keep toiletries together and organized, the kit cannot be brought into a shower stall and used during a shower. Furthermore, accessing individual bottles is cumbersome since the traveler must hunt through the kit, identify the correct bottle, remove the bottle, and then use and replace it before searching for the next bottle.

U.S. Pat. No. 5,183,182 shows a complicated panel that is not designed for easy portability. A shell 24 has a cover 28 hinged to the top of a back panel 26, which may be secured to a shower wall by glue, screws, or two-sided adhesive foam. A number of bottles can be placed on back panel 26 so lower pump handles 74 can protrude through cover 28. The panel has complex structure for holding bottles in a predetermined position. Bottles 20 can be filled with shampoo, grooming liquids, etc.

In U.S. Pat. No. 5,413,251 the bottles 16 can be filled with shampoo, conditioner, hand lotion, etc. Thereafter, the pump handles 32 can be inserted through holes in cover 14, which is then locked in place on back panel 12 so that caps 54 rest on ledge 56.

In U.S. Pat. No. 3,349,967 bottles 36 are screwed into annular tops 40, which are glued into counterbores 22 of countertop 12. The hinged front door 66 can be swung down in order to unscrew and refill bottles 36 with shampoo, mouthwash, hand lotion, etc.

In FIG. 6 of U.S. Pat. No. 4,969,580 bottles of shampoo and conditioner can be placed on shelves with their valve caps extending through notches in the shelves. The hanger is shown suspended by a hook on a shower head pipe.

In U.S. Pat. No. 5,174,503 housing 11 is mounted in a shower and a number of bottles 30 can be screwed into the underside of housing. The housing has a hand pump and dispenser nozzle for dispensing shampoo, etc.

In FIG. 1 of U.S. Pat. No. 3,178,061 four containers 34 rest on shelf 22 on the inside of refrigerator door 14. Faucets 28 protrude through notches in the front apron of shelf 22. Containers 34 can be filled with beverages by removing covers 42.

In U.S. Pat. No. 5,044,522, shampoo, conditioner, etc. can be poured through the openings 24 to fill the compartments 14 in container 12, which is suspended from the shower head by hanger 16. These liquids are dispensed by pressing dispensing buttons 56.

In U.S. Pat. No. 6,322,242 four large bottles of different cleaning chemicals are placed on a top rack and connected by caps 47 and tubes 42 to siphoning valves 28. When one of the siphoning valves 28 is operated, water from hose connection 31 is discharged while the cleaning chemical is drawn from one of the large bottles and mixed with the water.

In U.S. Pat. No. 4,463,462 bottles 18 and 20 can be removed from receiver 26 and replaced. The bottles are filled with oil and can be lifted as shown in FIG. 2 so that oil will be siphoned through line 22 to a shower head.

In U.S. Pat. No. 3,955,715 interlocking containers can be secured to the wall of a shower by adhesive strips. The container lids can be removed to refill the container with shampoo, liquid soap, etc.

In U.S. Pat. No. 4,728,006 squeeze bottles can be hung valve-end-down from a towel rack to dispense shampoo, conditioner, etc.

In U.S. Pat. No. 6,808,090 a suction cup supports a handle that is inserted into a pocket molded in the side of a bottle of shampoo, conditioner, or the like.

Accordingly, there is a need for an container that can hold a number of toiletry bottles that can be easily transported.

SUMMARY OF THE INVENTION

In accordance with the illustrative embodiments demonstrating features and advantages of the present invention, there is provided a pack for carrying and dispensing toiletries. The pack includes a container having (a) a floor with at least one lower opening, and (b) at least one wall with a front, a back, a right and a left portion. Also included is a plurality of bottles with pumping heads adapted to fit in the container with the pumping heads projecting through the at least one lower opening of the container. Each of the pumping heads, when inverted, are operable to dispense fluid from the bottle. The pack also includes a cover for locking the bottles in the container and providing a backstop for the bottles during operation of the pumping heads.

In accordance with another aspect of the invention, a pack is provided for carrying a plurality of bottles with pumping heads for dispensing toiletries. The pack includes a container having (a) a floor with at least one lower opening, and (b) at least one wall with a front, a back, a right and a left portion. The container is adapted to hold the plurality of bottles. The lower opening is arranged to allow the pumping heads to project through the at least one lower opening of the container. The pack also includes a cover for locking the bottles in the container and providing a backstop for the bottles during operation of the pumping heads.

In accordance with yet another aspect of the invention, a method is provided for carrying a plurality of bottles with pumping heads in a container with an open top and a floor with an opening. The method includes the steps of filling the plurality of bottles with different fluids at a first location, and placing the plurality of bottles inside the container with the pumping heads projecting through the opening in the floor of the container. Another step is covering the open top of the container to lock the bottles in the container and provide a backstop for the bottles during operation of the pumping heads. The method also includes the step of traveling to a destination with the bottles in the container, and hanging the container with the bottles from a shower head pipe with the pumping heads of the bottles pointing down. Another step is operating the pumping head of at least one of the bottles while the container is suspended from the shower head pipe.

By employing apparatus and methods of the foregoing type an improved toiletries pack is achieved. In one embodiment, a number of pump bottles can be placed, pumping head down, in a five-sided box that is open on top. The floor of the box has a number of holes designed to allow passage of the pumping heads. The box can be closed with a sliding lid, or with a hinged or snap-on lid that presses the pump bottles in place. Bundled in this fashion, the collection of pump bottles can be conveniently packed in a traveler's luggage.

The bottles can contain shampoo, conditioner, body wash or gel, shaving cream, toothpaste, hand or facial lotion, after shave, etc. The bottle's pumping heads can be swivelled to lock them closed, in some embodiments.

The box can be suspended by a strap, hook, or the like from the pipe of a shower head without unpacking the pump bottles. In some cases the box can be mounted elsewhere in a shower stall with suction cups. The pump bottles can be used by pressing the pump heads. In some embodiments the box can have a ledge (cantilevered or recessed) where a user can place one or more fingers to brace the box while another finger (or fingers) operates the pumping heads.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
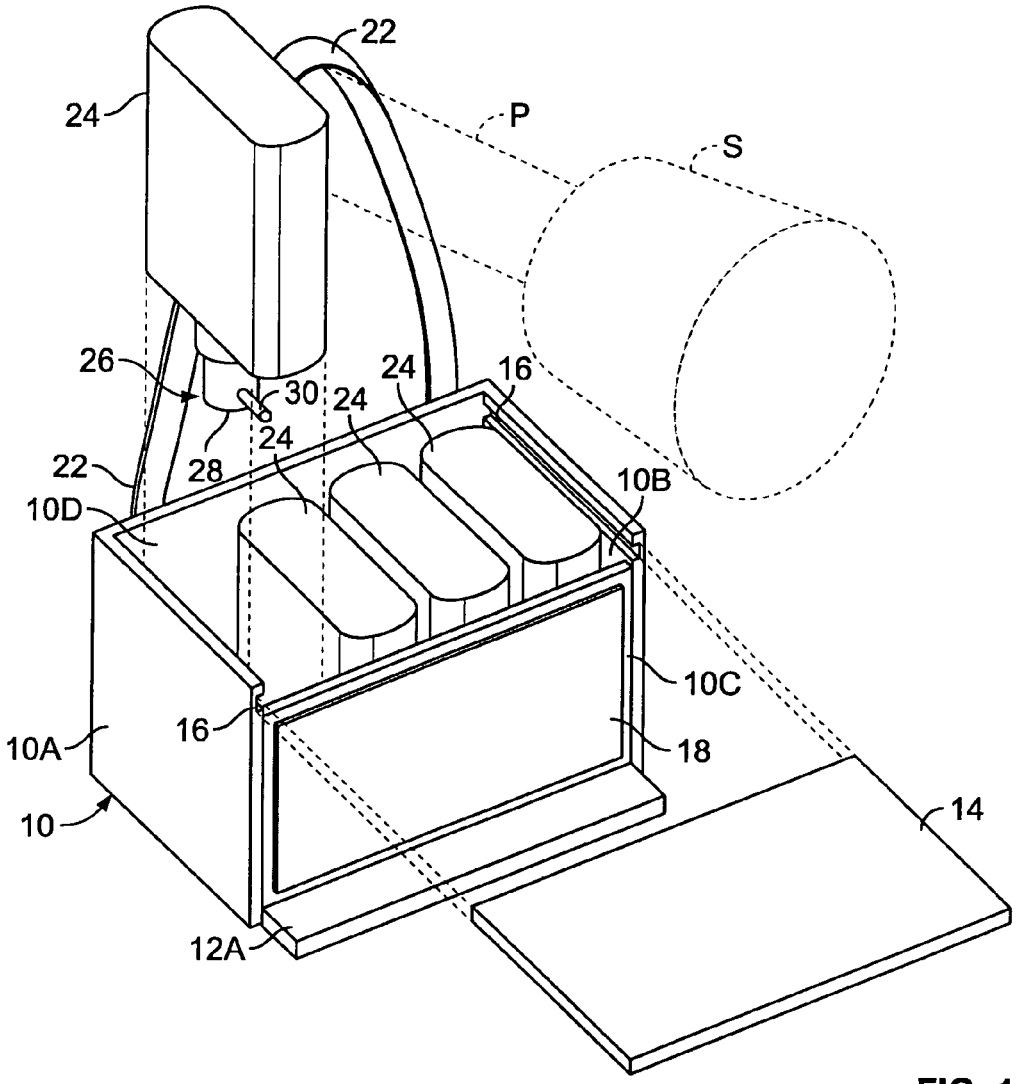
FIG. 1 is a perspective view of a pack in accordance with principles of present invention.
Figure 2:
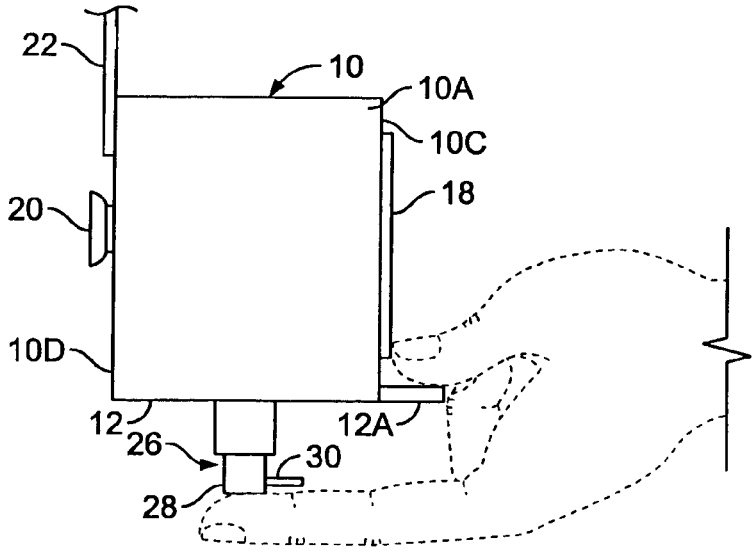
FIG. 2 is a left elevational view of the pack of FIG. 1.
Figure 3:
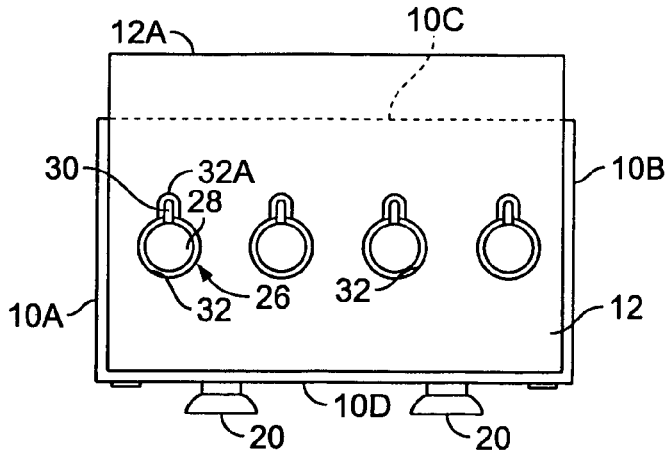
FIG. 3 is a bottom view of the pack of FIG. 1.

Referring to FIGS. 1–3, a pack is shown employing a container 10 in the form of a five-sided box that is open on top. Box 10 has a left portion 10A, a right portion 10B, a front portion 10C, and a back portion 10D. Box 10 has a floor 12 that is oversized and extends anteriorly into a cantilevered ledge 12A. A cover 14 is shown as a panel designed to slide into inside slots 16 formed at the inside of the upper edge of left portion 10A and right portion 10B.

The box can be made by injection molding, stamping and folding, or by assembling a number of discrete panels by means of glue, fasteners, snapping features, and the like. The box can be made of plastic, wood, metal, ceramic, composite materials, etc. In this embodiment ledge 12A is 0.5 inch (1.3 cm) deep and excluding the ledge, container 10 is, 2.5 inches (6.4 cm) deep, 5.5 inches (14 cm) wide, and 3.75 inches (9.5 cm) tall, although other dimensions and proportions can be employed in other embodiments.

A mirror 18 is secured to front portion 10C. A pair of suction cups 20 is attached to back portion 10. A hanger in the form of a flexible strap 22 has its two ends secured to the upper corners of the back portion 10D. Strap 22 is designed to suspend container 10 from a showerhead pipe P, which feeds a showerhead S.

Four identical bottles 24 can fit side-by-side inside container 10. Three of them are shown inside the container 10. Projecting from the bottom of all of the bottles 24 is a pumping head 26 having a plunger 28 with a nozzle 30. Pumping head 26 is a conventional device that can dispense the fluid inside bottle 24 by vertically reciprocating plunger 28 so the fluid is dispensed through nozzle 30. Each of the bottles 24 is can be refilled by unscrewing pumping head 26 from the externally threaded collar (not shown) at the bottom of bottle 24. Pumping head 26 is of the type that can be locked to prevent leakage by rotating plunger 26 approximately 90°.

In this embodiment bottle 24 has an overall height of 5.25 (13 cm) inches, a thickness of 1 inch (2.5 cm), and a width of 2 inches (5 cm). Excluding the pumping head 26, bottle 24 has a generally rectangular shape with rounded edges and corners and is designed to hold about four ounces (12 ml) of fluid. The main body of bottles 24 can be made of glass, plastic, metal, or other materials. The pumping head 26 has an overall outside diameter of 1 inch (2.5 cm) and an overall height of 1.5 inches (3.8 cm). The plunger 28 has a diameter of 0.75 inch (1.9 cm) and a height of 0.5 inch (1.3 cm). It will be appreciated that bottles of different sizes, shapes and capacities can be employed in other embodiments. Bottles 24 are designed to be filled with any one of various fluids, such as shampoo, conditioner, body wash or gel, shaving cream, toothpaste, hand or facial lotion, after shave, etc.

The pumping heads 26 of bottles 24 are shown projecting through four keyhole-shaped apertures 32 (lower opening) in the floor 12. The slot 32A of each of the holes 32 is designed to pass the nozzle 30 of pumping head 26.

Thus, when cover 14 is slid in slots 16 over the top of bottles 24, the bottles are securely pressed against the floor 12 so that the pumping heads 26 are fixed in place.

Figure 4:
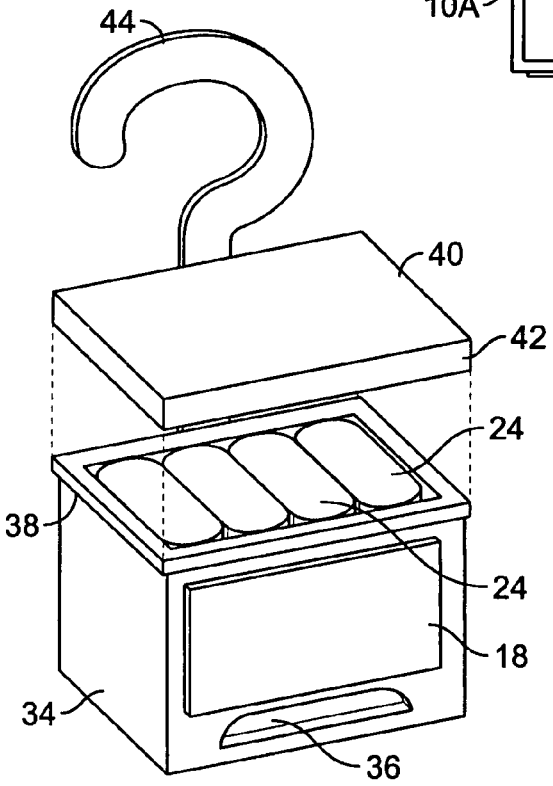
FIG. 4 is a perspective view of a pack that is an alternate to that of FIG. 1.

Referring to FIG. 4, components identical to those previously illustrated in FIGS. 1–3 bear the same reference numerals. Container 34 has a shape fairly similar to the previously mentioned container (container 10 FIG. 1) and is fitted with the same mirror 18 in front. Container 34 will also have holes similar to those previously described (holes 32 of FIG. 3).

Container 34 differs in that its ledge is in the form of an alcove 36. Also, container 34 has a locking rim 38 in the form of a small flange. A cover 40 is shown as a lid having a dependent lip designed to snap over the locking rim 38 to hold bottles 24 in place. Attached to back of container 34 is a hook 44 designed to suspend container 34 from the previously mentioned showerhead pipe.

Figure 5:
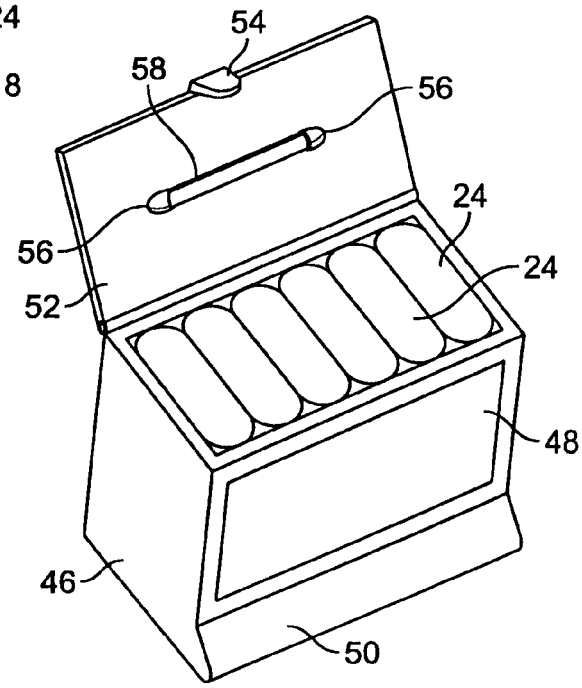
FIG. 5 is a perspective view of a pack that is an alternate to those shown in the previous drawings.

Referring to FIG. 5, components identical to those previously illustrated in FIGS. 1–3 bear the same reference numerals. Container 46 has a shape fairly similar to the previously mentioned container (container 10 FIG. 1) but is somewhat larger and is designed to hold six bottles 24 side-by-side. The front of container 46 has a mirror 48 that fits flush in a recess. Container 46 will also have holes similar to those previously described (holes 32 of FIG. 3).

Container 46 has a molded cantilevered ledge 50 with a curved, sloping upper surface. Hinged to the rear upper edge of container 46 is a cover 52 having a latch 54 designed to snap cover 52 closed on container 46. A strap 58 is looped through a pair of holes 56 on cover 52. Strap 58 is designed to suspend container 46 on a showerhead pipe.

To facilitate an understanding of the principles associated with the foregoing apparatus, its operation will be briefly described in connection with the embodiment of FIGS. 1–3. It will be appreciated that the operation of the other embodiments will be similar. With the cover 14 removed as shown in FIG. 1, each of the bottles 24 can be opened by unscrewing its pumping head 26 (head pointing up) in order to fill the bottle with an appropriate toiletry, such as shampoo, conditioner, body wash or gel, shaving cream, toothpaste, hand or facial lotion, after shave, etc. Thereafter, the pumping head 26 can be screwed back in place and the bottles 24 placed inside container 10 with pumping heads 26 projecting down through the lower openings 32 as shown in FIG. 3. Cover 14 can then be slid into slots 16 to clamp bottles 24 in place.

If the user is planning to travel, the plungers 28 can be rotated to close the pumping heads 26. This allows the pack to be conveniently stored in luggage without substantial risk of leakage. When the traveler wishes to use the pack, plungers 26 are then rotated back into the operative position illustrated in FIGS. 1 and 3. The strap 22 may then be used to suspend container 10 on showerhead pipe P. Suction cups 20 can provide additional stability by holding container 10 securely against the wall of a shower stall.

Referring to the hand H of FIG. 2, the user may now place a thumb on ledge 12A and one or more other fingers under plunger 28. By lifting these other fingers plunger 28 is depressed so that the fluid inside the associated bottle 24 is dispensed through nozzle 30 onto the user's fingers. The upward pressure on plunger 28 from these fingers is counteracted by the downward thumb pressure on ledge 12A so that container 10 essentially stays fixed in place. The mirror 18 can be used at any time before, during, or after operation of pumping head 26.

When the container 10 and its contents are no longer needed in a shower, the pack can be stored as an organized group of toiletries, for example in the user's luggage. Because the various bottles 24 are kept together, they remain organized and are easily found when needed during a shower or any other time.

It is appreciated that various modifications may be implemented with respect to the above described, preferred embodiment. In some embodiments the foregoing containers can have a plan that is circular, oval, polygonal, etc. Also, the bottles may have an outline that is circular, oval, polygonal, etc. Additionally, the inside of the container may have appropriate ridges, dividing walls or channels designed to embrace the bottles and keep them in position. Also, two, three or any greater number of bottles may be employed and the container will be sized accordingly. Furthermore, container may at times have less than the maximum number of bottles that will fit. Additionally, various types of alternate pumps can be used and in some cases the bottles will be installed in holes in the container floor before screwing the pump heads onto the bottles. Moreover, the hanger for suspending the pack on a showerhead pipe may attach to different parts of the container, and in some cases may be in the form of a wireframe, a basket, a shelf, etc. In addition, the openings in the floor of the container may have various shapes or be combined into one long opening through which all the pump heads project.

Obviously, many modifications and variations of the present invention are possible in light of the above teachings. It is therefore to be understood that within the scope of the appended claims, the invention may be practiced otherwise than as specifically described.

The invention claimed is:

1. A pack for carrying and dispensing toiletries, comprising:

a container having (a) a floor with at least one lower opening, and (b) at least one wall with a front, a back, a right and a left portion;

a mirror attached to the front portion of said container;

a plurality of bottles with pumping heads adapted to fit in said container with said pumping heads projecting through the at least one lower opening of said container, each of said pumping heads when inverted being operable to dispense fluid from said bottle; and a cover for locking said bottles in said container and providing a backstop for said bottles during operation of said pumping heads, said container having on the left and the right portion of the container an opposing pair of inside slots, said cover comprising a panel sized to slide into said inside slots.

2. A pack according to claim 1 comprising:

a hanger attached to said container for suspending it from a shower head pipe.

3. A pack according to claim 2 wherein said hanger is a flexible strap.

4. A pack according to claim 2 wherein said hanger is a hook.

5. A pack according to claim 1 wherein said at least one opening in the floor of said container includes a plurality of holes each sized to receive the pumping head of a corresponding one of said plurality of bottles.

6. A pack according to claim 1 wherein said container has at the front portion a ledge sized to engage a finger to brace said container during operation of the pumping head of one of the bottles.

7. A pack according to claim 6 wherein said ledge is cantilevered adjacent the floor of said container.

8. A pack according to claim 1 comprising:

at least one suction cup on the back portion of said container.

9. A pack according to claim 1 wherein said pumping heads each have a plunger that is axially reciprocatable, said plunger being rotatable about its axis to prevent axial reciprocation and close the pumping head.

10. A pack according to claim 1 wherein said container has a locking rim, said cover comprising a lid with a dependent lip arranged to snap onto the locking rim of said container.

11. A pack for carrying a plurality of bottles with pumping heads for dispensing toiletries, comprising:

a container having (a) a floor with at least one lower opening, and (b) at least one wall with a front, a back, a right and a left portion, said container being adapted to hold the plurality of bottles, the lower opening being arranged to allow the pumping heads to project through the at least one lower opening of said container;

a mirror attached to the front portion of said container; and a cover for locking said bottles in said container and providing a backstop for said bottles during operation of said pumping heads, said container having on the left and the right portion of the container an opposing pair of inside slots, said cover comprising a panel sized to slide into said inside slots.

12. A pack according to claim 11 comprising:

a hanger attached to said container for suspending it from a shower head pipe.

13. A pack according to claim 11 wherein said at least one opening in the floor of said container includes a plurality of holes each sized to receive the pumping head of a corresponding one of said plurality of bottles.

14. A pack according to claim 11 wherein said container has at the front portion a ledge sized to engage a finger to brace said container during operation of the pumping head of one of the bottles.

15. A pack according to claim 14 wherein said ledge is cantilevered adjacent the floor of said container.

16. A pack according to claim 11 comprising:

at least one suction cup on the back portion of said container.

17. A pack according to claim 11 wherein said container has a locking rim, said cover comprising a lid with a dependent lip arranged to snap onto the locking rim of said container.

* * * * *